US005933992A

United States Patent [19]

Padiak et al.

[11] Patent Number: 5,933,992

[45] Date of Patent: Aug. 10, 1999

[54] CAM LOCKING SIGN MOUNTING SYSTEM

[75] Inventors: Scott Padiak, Winnetka; Thomas M. Conway, Chicago, both of Ill.

[73] Assignee: Cormark, Inc., Rosemont, Ill.

[21] Appl. No.: 09/047,087

[22] Filed: Mar. 24, 1998

[51] Int. Cl.[6] ..... G09F 15/00

[52] U.S. Cl. ..... 40/607; 40/617; 248/246; 248/297.21

[58] Field of Search ..... 40/606, 617, 607; 248/297.21, 246

[56] References Cited

U.S. PATENT DOCUMENTS

| | | | |
|---|---|---|---|
| Re. 30,734 | 9/1981 | Eckert . | |
| 268,616 | 12/1882 | Brown . | |
| 1,111,458 | 9/1914 | Hight . | |
| 1,220,758 | 3/1917 | Lamphiear . | |
| 1,559,010 | 10/1925 | Schwieger . | |
| 1,793,563 | 2/1931 | Schwartz . | |
| 1,866,723 | 7/1932 | Powers . | |
| 2,646,241 | 7/1953 | McLean . | |
| 2,787,433 | 4/1957 | Slavsky et al. . | |
| 2,845,729 | 8/1958 | Baumgart . | |
| 3,082,989 | 3/1963 | Bower . | |
| 3,102,351 | 9/1963 | Howell . | |
| 3,529,798 | 9/1970 | Williams et al. . | |
| 3,669,392 | 6/1972 | Saunders . | |
| 3,969,838 | 7/1976 | Moore . | |
| 4,344,244 | 8/1982 | Tyke . | |
| 4,369,948 | 1/1983 | Krauss et al. . | |
| 4,531,311 | 7/1985 | Howard et al. . | |
| 4,574,507 | 3/1986 | Elliott . | |
| 4,593,486 | 6/1986 | Visocky et al. . | |
| 4,616,799 | 10/1986 | Rebentisch . | |
| 4,709,891 | 12/1987 | Barnett . | |
| 4,729,183 | 3/1988 | Tarter et al. . | |
| 4,791,739 | 12/1988 | Hetzer . | |
| 4,798,013 | 1/1989 | Sainato . | |
| 4,805,331 | 2/1989 | Boggess et al. . | |
| 4,821,437 | 4/1989 | Abramson et al. . | |
| 4,866,867 | 9/1989 | Clark . | |
| 4,869,376 | 9/1989 | Valiulis et al. . | |
| 4,881,707 | 11/1989 | Garfinkle . | |
| 4,884,351 | 12/1989 | Abramson . | |
| 4,909,464 | 3/1990 | Levine et al. . | |
| 4,911,393 | 3/1990 | Aplerson | 248/297.21 |
| 4,957,256 | 9/1990 | Boeding . | |
| 5,007,608 | 4/1991 | Carroll, Jr. | 248/297.21 |
| 5,106,046 | 4/1992 | Rowles et al. . | |
| 5,111,606 | 5/1992 | Reynolds . | |
| 5,189,822 | 3/1993 | Schmanski et al. . | |
| 5,230,174 | 7/1993 | Reed . | |
| 5,237,767 | 8/1993 | Kringel et al. . | |
| 5,383,793 | 1/1995 | Hsu et al. . | |
| 5,408,775 | 4/1995 | Abramson et al. . | |
| 5,419,134 | 5/1995 | Gibson | 40/617 |
| 5,472,289 | 12/1995 | Kringel et al. . | |

*Primary Examiner*—Cassandra H. Davis
*Attorney, Agent, or Firm*—Welsh & Katz, Ltd.

[57] ABSTRACT

A sign mounting system for adjustably mounting a sign such as a sheet or panel to an associated structure includes an elongated frame portion mountable to the sign and a mounting element for mounting the frame to the structure. The frame portion includes a central runner and side walls extending generally transversely from the runner. The side walls are spaced from one another and in conjunction with the runner define a track. The side walls each terminate in a lip spaced from the runner a first predetermined distance. The mounting element includes a cam having first and second sliding surfaces spaced from one another a distance substantially equal to the first predetermined distance, and first and second camming surfaces spaced from one another a distance greater than the first predetermined distance. The mounting element is pivotal between a first adjusting position in which the sliding surfaces are adjacent the runner and lips, and a second locking position in which the camming surfaces engage and lock between the runner and lips.

18 Claims, 3 Drawing Sheets

CAM LOCKING SIGN MOUNTING SYSTEM

FIELD OF THE INVENTION

This invention pertains to a sign mounting system. More particularly, the invention pertains to a sign mounting system that utilizes a frame for supporting a sign and an adjustable support having a cam lock arrangement to mount the sign to a structure.

BACKGROUND OF THE INVENTION

Point-of-purchase displays and signs are used in a wide variety of retail trades. Such signs are available in a large number of different types and sizes. Some of these displays and signs vary from active, e.g., rotating displays, to more traditional stationary signs that may be mounted to structures such as shelving, as well as overhead signs.

One known point-of-purchase display is mounted to a rack or storage shelf from the shelf or shelves, or from a vertical support element such as a shelf standard. These signs provide readily visible signage to, for example, direct consumers' attention to the merchandise stocked on the shelf. Most consumers will recognize these signs as being those that extend outwardly from the shelf or from the shelf support standard into an aisle-way. While these signs are extremely effective in directing a consumer's attention to a particular location, item or product, because these signs extend into an aisle-way, they can be readily struck and damaged by an individual walking through the aisle, a shopping cart, a forklift or other truck that may be used for transporting items for restocking the shelves.

One known type of mounting system for such an aisle-way installation location includes one or more rigid support portions that extend from the shelf or the shelf standard to the body of the sign. It has been observed that such rigid support members do not readily absorb the impact of the sign being struck. As a result, the signs or mounts are often bent, damaged or broken when struck. Another type of sign mount includes hinges that permit the sign to rotate or pivot in the event that the sign is struck. While such mounts reduce the opportunity for damaging the sign or mount, these mounts are mechanical elements that can require frequent maintenance, repair or replacement to maintain the hinge elements operable and the sign in a visually acceptable condition.

Still another known type of sign mount system includes a support portion that is permanently affixed to the shelf or shelf standard and a co-extrusion of a rigid plastic having a flange formed therein and further includes a flexible, resilient plastic strip that forms a hinge that extends between the flange and the sign. Although this system appears to work well for its intended function, the co-extrusion process can become quite complicated and can increase the cost of fabricating such a sign support.

Accordingly, there exists a need for a sign support that withstands impact without permanently damaging the sign or the support. Desirably, such a support system is flexible in design and permits use of the system with any of a variety of sizes of signs. Such a system further incorporates sufficient design flexibility that the mounting system can be installed on shelves that are spaced from one another at varying distances as well as shelf system vertical supports.

SUMMARY OF THE INVENTION

A sign mounting system is provided for adjustably mounting a sign such as a sheet or panel, sometimes referred to as a graphic, to an associated structure. The system includes generally an elongated frame portion mountable to the sign and a mounting element that extends between and mounts the frame to the structure.

Advantageously, the present mounting system permits a system by which an aisle-way-type sign can be mounted to a shelf or standard without the attendant fear of damage resulting from being struck by, for example, a shopper, a shopping cart or passing-by equipment such as a forklift. The sign provides a support system that is not only structurally flexible, but is also flexible in design.

One feature of the present system permits adjustably securing the frame to the mount, anywhere along the length of the frame, so that the height and/or placement of the sign can be optimized. By simply rotating the mounting element relative to the frame, and sliding the element along the frame, the location at which the element secures to the frame can be selected and readily changed.

The frame portion includes a central runner and spaced apart side walls extending generally transversely from the runner. Each side wall terminates in a lip spaced from the runner a first predetermined distance. The runner and side walls define a track. Preferably, the lips are oriented inwardly of the track and include a hook portion at an end thereof defining a shoulder in the track.

The mounting element is mounted to the associated structure and adjustably mountable to the frame portion. The mounting element includes a cam having first and second sliding surfaces spaced from one another a distance substantially equal to the first predetermined distance, and first and second camming surfaces spaced from one another a distance greater than the first predetermined distance. The mounting element is pivotal between a first adjusting position and a second locking position.

In the adjusting position, the cam is adjustably positionable within the track with the sliding surfaces adjacent the runner and lips, and in the locking position, the cam is positioned with the camming surfaces in engagement with the runner and lips. Preferably, the cam has an asymmetrical wedge shape formed by an intersection of the first camming surface and the second sliding surface at a front portion of the wedge.

The mounting members can include a base plate and an extension portion connecting the base plate to the cam. The mounting members can be configured to mount the sign to an associated vertical structure or an associated horizontal structure. In a most preferred embodiment, each mounting element includes a base plate and an extension portion connecting the cam and the base plate, and the cam has grooves formed therein that are separated from one another by the extension portion. In this configuration, the grooves are further defined by cam outer walls that are disposed within the track shoulder regions and engage the track hook portions when the cam is engaged with the track.

The cam can include an arcuate surface extending between the sliding surfaces to facilitate rotating the cam into and out of the locked position. The arcuate surface can be configured to form a portion of the second camming surface.

Other features and advantages of the present invention will be apparent from the following detailed description, the accompanying drawings, and the appended claims.

DETAILED DESCRIPTION OF THE PREFERRED EMBODIMENTS

Figure 1:
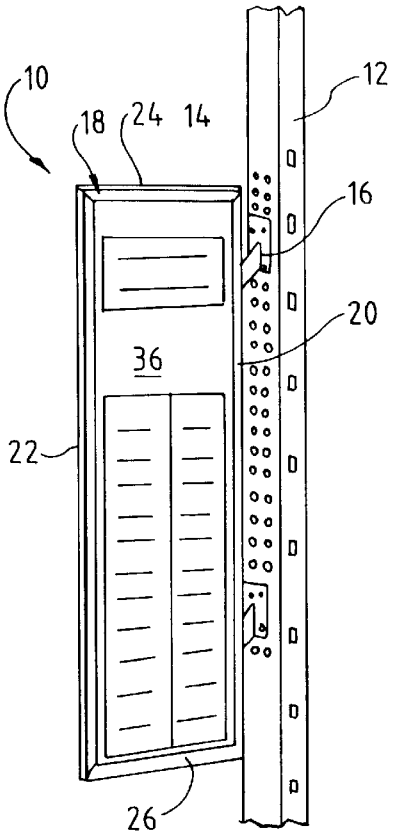
FIG. 1 is a perspective view of a cam locking sign mounting system embodying the principles of the present invention, the sign being illustrated mounted to a vertical post, such as a shelf support standard.
Figure 2:
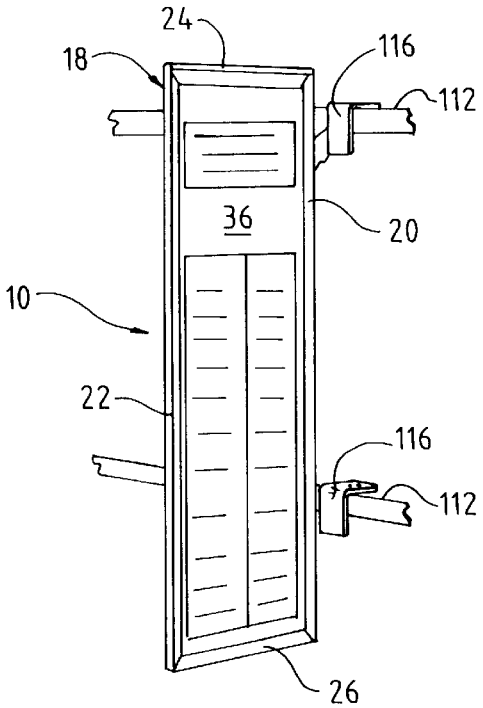
FIG. 2 is a perspective view of the sign mounting system illustrating a sign mounted to a pair of horizontally oriented shelves.
Figure 3:
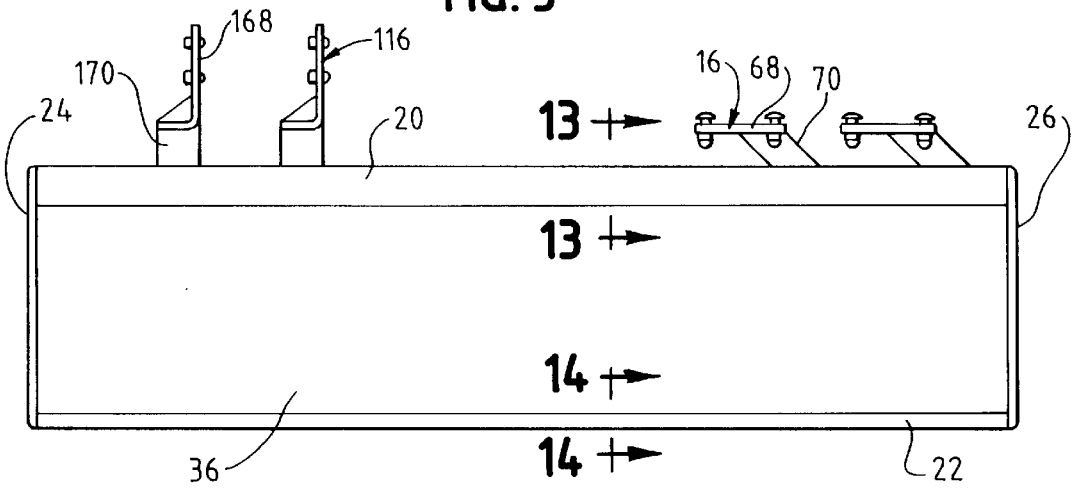
FIG. 3 is a top view of a sign and the mounting system of the present invention, the sign being illustrated with a pair of vertical mounts and a pair of horizontal mounts positioned thereon.
Figure 4:
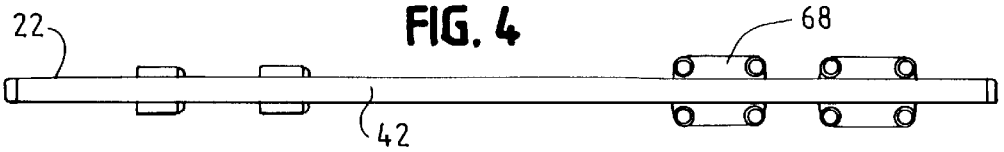
FIG. 4 is a front view of the sign of FIG. 3.
Figure 5:
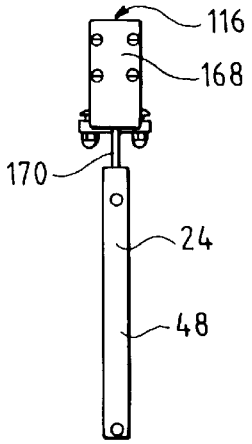
FIG. 5 is a top view of the sign of FIG. 3.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 6:
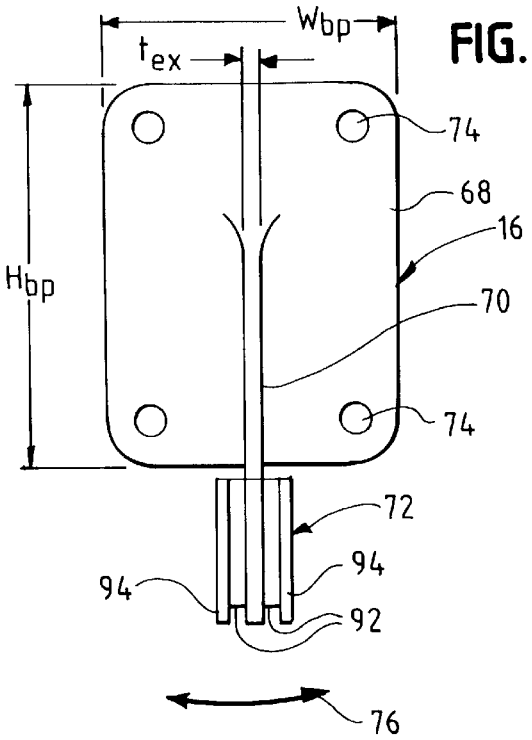
FIG. 6 is a front view of the vertical support element of the shelf mount system of the present invention, as illustrated in FIG. 3.
Figure 7:
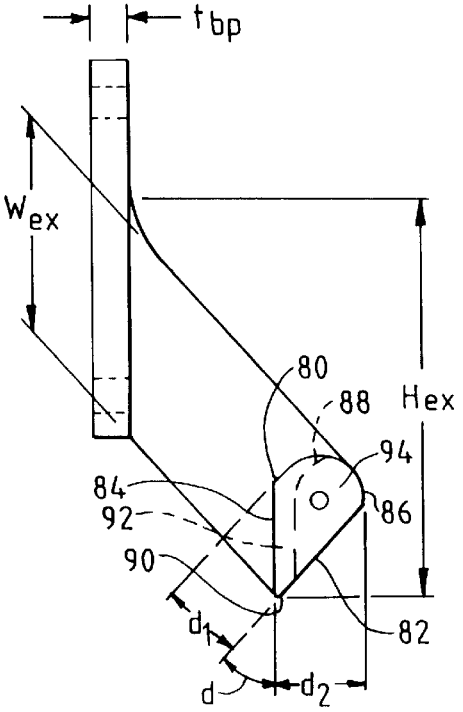
FIG. 7 is a side view of the vertical support element of FIG. 6.
Figure 8:
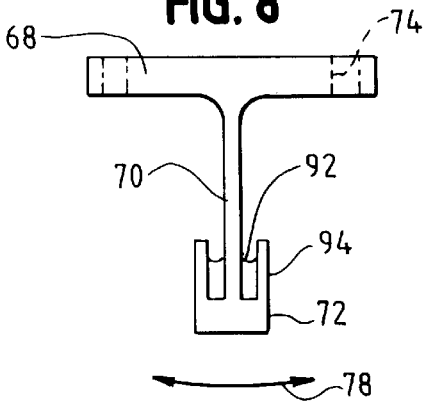
FIG. 8 is a top view of the vertical support element of FIG. 6.
Figure 9:
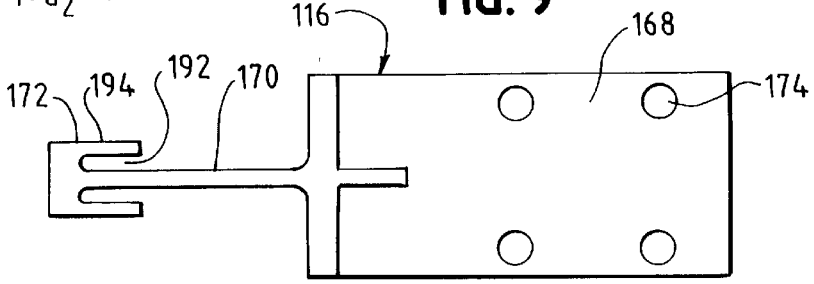
FIG. 9 is a bottom view of the horizontal support element as illustrated in FIG. 3.
Figure 10:
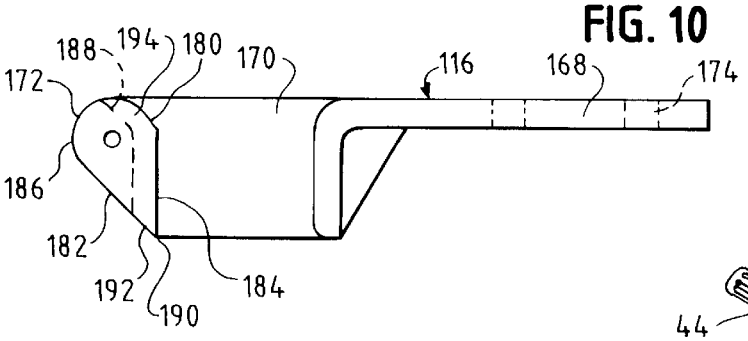
FIG. 10 is a side view of the horizontal support element of FIG. 9.

Referring now to the figures, and in particular to FIG. 1, there is shown a sign 10 mounted to a vertical support 12, such as a shelf standard, by a cam locking sign mounting system 14 embodying the principles of the present invention. The mounting system 14 includes, generally, one or more support elements 16 and a frame 18 that forms the sides, top and bottom of the sign 10. The mounting elements 16, two types of which are shown in FIGS. 6–10 (FIGS. 6–8 illustrating a vertical mounting element 16 and FIGS. 9–10 illustrating a horizontal mounting element 116) extend between the rigid structure, that is the shelf standard 12, or shelf 112, respectively, and the sign 10.

Figure 13:
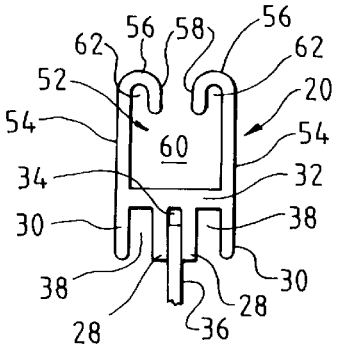
FIG. 13 is a cross-sectional view taken substantially along line 13—13 of FIG. 3, illustrating the cam support portion of the frame.
Figure 14:
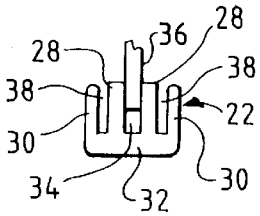
FIG. 14 is a cross-sectional view taken substantially along line 14—14 of FIG. 3, illustrating the end or outer portion of the frame.

The frame 18 includes a cam or mount support rail 20, an outer rail 22 and Upper and lower end caps 24 and 26, respectively. As seen in FIGS. 13 and 14, each of the cam support rail 20 and the outer rail 22 have inner and outer flanges 28 and 30, respectively, that are joined by a runner portion 32. The inner flanges 28 define a space 34 that is configured to receive, for example, a sheet or panel 36, for mounting to the rails 20, 22. Alternately, spaces 38 are defined between each inner flange 28 and its respective outer flange 30 that can accommodate one or more sheets or panels 36. The sheet or panel 36 can be mounted to the rails 20, 22 by, for example, an adhesive. The outer rail 22 includes a finished surface 42 that provides a neat and outwardly aesthetically acceptable appearance.

Figure 11:
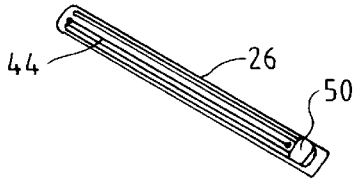
FIG. 11 is a perspective view of a bottom cap used to form a portion of the frame of the present sign mounting system.

The upper and lower caps 24, 26 each include an inner surface that is configured to mount to the rails 20, 22. Referring to FIG. 11, it can be seen that the caps 24, 26 also include recesses 44 into which the upper and lower edges of the sheet or panel 36 can be fitted and secured the caps with, for example, an adhesive.

Figure 12:
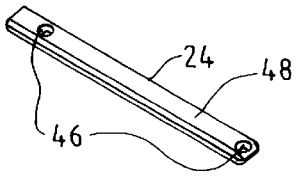
FIG. 12 is a perspective view of the top cap of the frame.

As seen in FIG. 12, the caps 24, 26 have openings 46 therein, that are preferably countersunk, and are configured to receive fasteners (not shown), such as screws, to secure the caps 24, 26 to the cam support and outer rails 22, 24. Similar to the outer rail 22, the end caps 24, 26 have a finished outer surface 48 that provides a neat and aesthetically acceptable appearance.

To properly position the caps 24, 26 on the rails 20, 22, the caps 24, 26 can each include a centering projection 50 that is adapted to fit into an opening 52 in the cam rail 20. In this arrangement, the caps 24, 26 can be properly positioned on the rails 20, 22, as the fasteners are driven through the caps 24, 26 into the rails 20, 22.

The cam rail 20 includes side walls 54 that extend from the runner portion 32 in substantially opposing relation to the outer flanges 30. The walls 54 each terminate in an engaging lip 56 at a free end thereof. In a current embodiment, the engaging lips 56 have inwardly, opposingly oriented generally-J-shaped cross-sections, as indicated at 58, that define, in conjunction with the side walls 54, a track 60 for securing the mounting element 16, 116 thereto. As is best seen in FIG. 17, the track 60 includes mirror image shoulder regions 62 that are defined, in part, by the opposingly oriented J-lips 58.

Referring now to FIGS. 6–8 and 9–10, there are shown the vertical and horizontal mounting elements, 16, 116, respectively. With reference to the vertical element 16, which is adapted to mount the sign 10 to a vertical support member 12, such as a shelf standard (FIG. 1), the mounting element 16 includes a base plate 68, an extension portion 70 and a cam or track retaining portion 72. The base plate 68 includes openings 74 though which fasteners (not shown), such as bolts or screws, can be inserted to fasten the mounting element 16 to the standard 12.

The extension portion 70 extends between the base plate 68 and the cam 72. The extension portion 70 illustrated in FIGS. 6–8 angles downwardly from the base plate 68 to the cam 72. However, it will be apparent from the drawings that the extension portion can extend in other orientations between the plate 68 and the cam 72, and can be, for example, upwardly angled or generally normal to the plate 68. The extension portion 70 has a cross-section that is small relative to the cam 72 and the base plate 68. Advantageously, this configuration permits the mounting element 16 to bend or flex at about the extension portion 70, as illustrated by the arrows indicated at 76 and 78 in FIGS. 6 and 8, respectively, without resulting in permanent damage, e.g., plastic deformation or yielding, of the extension member 70.

As will be discussed in more detail herein, this is due in part to the design of the mounting element 16 as well as the material from which the mounting element 16 is fabricated, and permits use of the present mounting system 14 in areas where the sign 10 may be struck by a person or an object passing by. In a present embodiment, the base plate 68 has a width $W_{bp}$ of about 1.4 inches, a height $H_{bp}$ of about 2 inches and a thickness $t_{bp}$ of about 0.26 inches, and the extension portion 70 has a width $W_{ex}$ of about 1 inch, a height $H_{ex}$ of about 1.7 inches and a thickness $t_{ex}$ of about 0.115 inches.

Figure 15A:
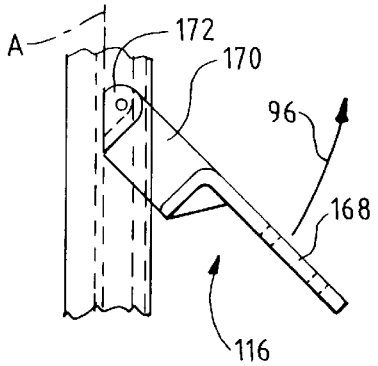
FIGS. 15*a* and *b* are side views taken in partial cross-section illustrating a mounting element in the track of the cam support rail in the adjusting or sliding position (FIG. 15*a*) and in the locked or secured position (FIG. 15*b*).
Figure 15B:
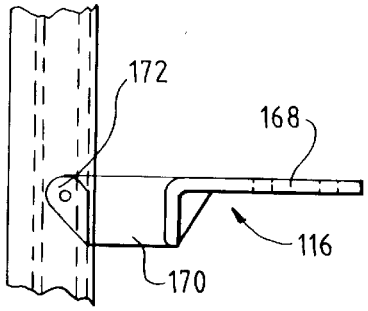

The cam 72 is disposed on the extension portion 70 in spaced relation to the base plate 68, and is configured to slide within the track 60, and to lock into the track 60 thus securing the mounting element 16 to the frame 18. To this end, the cam 72 is pivotal within the track 60 between a sliding or adjusting position as illustrated in FIG. 15*a*, in which the cam 72 freely slides or adjusts along the track 60 and a locking or securing position as illustrated in FIG. 15*b* in which the cam 72 locks into the track 60 by engagement with the side walls 54, engaging lips 56 and runner 32.

In a preferred embodiment, the cam 72 has an asymmetrical wedge shape defining first and second substantially parallel sliding surfaces 80, 82, respectively, spaced from one another a predetermined distance $d_1$. As best seen in FIG. 7, angularly disposed to the sliding surfaces 80, 82, the cam 72 includes first and second camming surfaces 84, 86, respectively, spaced from one another a distance $d_2$ greater than the distance $d_1$ that separates the sliding surfaces 80, 82. An arcuate or curved surface 88 extends between the sliding surfaces 80, 82 and can form a portion of the second camming surface 86. The sliding and camming surfaces 80–86 are formed in the cam 72 at an angle $\alpha$ relative to one another. The wedge shape of the cam 72 is formed by the intersection of the first camming surface 84 and the second sliding surface 82 at the front of the wedge as indicated at 90, that defines the angle $\alpha$.

Preferably, the cam 72 includes grooves 92 therein that are generally parallel to, e.g., having generally the same contour as, the path defined by the first sliding surface 80 and the first camming surface 84. The grooves 92 are separated from one another by the extension portion 70 as it intersects the cam 72, and are further defined by outer walls 94 of the cam 72.

The horizontal mounting element 116 illustrated in FIGS. 9–10, likewise includes a base plate 168 for mounting to the associated structure 112, e.g., a shelf, and an extension portion 170 and cam 172. The cam 172 is formed similar to the cam 72 of the vertical member 16, and includes first and second sliding surfaces 180, 182, respectively, and first and second camming surfaces 184, 186, respectively, that are angularly disposed relative to one another by the angle $\alpha$. The cam 172 includes grooves 192 that have generally the same contour as the path defined by the first sliding surface 180 and the first camming surface 184. Like the cam 72 in FIGS. 6–8, the grooves 192 of the horizontal element cam 172 are separated from one another by the extension portion 170 as it intersects the cam 172.

In a preferred embodiment, the mounting elements 16, 116 are formed from a material that permits the element 16, 116 to be flexed, about their respective extension portions 70, 170, without the material yielding or plastically deforming. As such, in the event that the sign 10 is struck or the mounting element 16, 116 is otherwise bent, for example, as illustrated by the arrows at 78 and 178 in FIGS. 8 and 9 respectively, the mounting elements 16, 116 and more specifically, the extension portions 70, 170 will return to their non-stressed state, as illustrated in FIGS. 8 and 9.

Advantageously, the present cam locking system 14 provides a flexible and readily adjustable system for mounting a sign 10 to an associated structure 12, 112. Referring to FIG. 1, the system 14 is configured so that the sign 10 can be mounted to the vertical standard 12 using one or more mounting elements 16. That is, the sign 10 can be mounted with only element 16, or if desired, additional elements can be used to secure the sign 10 to the standard 12. Likewise, when using the horizontal mounting elements 116, the sign 10 can be secured to a single shelf 112 by use of a single mounting element 116, or the sign 10 can be mounted to a plurality of shelves using a plurality of mounting elements.

For purposes of the following description, reference will be made to the horizontal mounting element 116 and arrangement. However, it will be recognized by those skilled in the art that the following description applies equally well to the vertical element 16 and arrangement. In use, a desired location and position for the sign 10 is determined, and an appropriate, e.g., vertical or horizontal, mounting element 16, 116 is selected. If more than one element 116 is desired, the appropriate number of mounting elements 116 is selected and the desired spacing between the elements 116 is determined.

Each mounting element 116 is then inserted into the track 60 with the cam 172 positioned so that the sliding surfaces 180, 182 are parallel to the track axis A as illustrated in FIG. 15*a*. When the desired location for the mounting element 116 is selected, as shown in FIG. 15*b*, the element 116 is rotated (as indicated by the arrow at 96) relative to the rail 20, so that the camming surfaces 184, 186 engage the runner 32 and lips 56, thus snugging the cam in the track 60. In this orientation, the cam 172 is positioned with the camming surfaces 184, 186 parallel to the track axis A. The arcuate surface 188 facilitates rotating the cam 172 into and out of the locked position.

When the mounting member 116 and thus the cam 172 is rotated within the track 60, it locks into the track 60 to securedly position the mounting member 172 therein. With the cam 172 in the engaged or locked position, the J-lips 58 contact the cam 172 within the grooves 192. In this manner, engagement of the lips 58 in the grooves 192 and the cam outer walls 194 in the track shoulder regions 62 prevents the side walls 54 of the rail 20 from bending or flexing outward and provides further support for maintaining the cam 172 locked or secured in the track 60.

Repositioning the mounting member 116 along the rail 20 is readily accomplished by rotating the mounting element 116 in a direction opposite to the arrow indicated at 96 so that the sliding surfaces 180, 182 are again parallel to the track axis A (FIG. 15*a*) and sliding the element 116 to the desired location. When the desired location is reached, the element 1 16 is rotated so that the cam surfaces 184, 186 are parallel to the track axis A and engage the runner 32 and lips 56 (FIG. 15*b*).

As will be apparent from the figures, the extension portions 70, 170, although illustrated in an angled orientation in element 16 and in a straight orientation in element 116, can take a wide variety of sizes, shapes and orientations. Such sizes, shapes and orientations are within the scope of the present invention.

In a current embodiment, the rails 20, 22 are formed by an extrusion process from acrylonitrile-butadiene-styrene copolymer ("ABS") or polyvinyl chloride ("PVC"), and the end caps 24, 26 are formed in an injection molding process from ABS or PVC. Likewise, the mounting elements 16, 116 are formed in an injection molding process; however, the elements 16, 116 are formed from a material that has both sufficient rigidity to maintain the sign in a relatively fixed position, and sufficient resiliency so that if struck or bent, an element 16, 116 will return to its pre-struck, non-stressed state, without permanently deforming, e.g., plastically deforming or yielding. Examples of such material are polypropylene and high-density polyethylene ("HDPE"); however, those skilled in the art will recognize that other materials that can be used to form the mounting elements 16, 116.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A sign mounting system for adjustably mounting a sign such as a sheet or panel to an associated structure comprising:

an elongated frame portion mountable to the sign, the frame portion having a runner and side walls spaced from one another and extending generally transversely from the runner, the runner and side walls defining a track, each side wall terminating in a lip spaced from the runner a first predetermined distance; and a mounting element mountable to the associated structure and adjustably mountable to the frame portion, the mounting element having a cam having first and second sliding surfaces spaced from one another a distance substantially equal to the first predetermined distance, and first and second camming surfaces spaced from one another a distance greater than the first predetermined distance, the mounting element being pivotal between a first adjusting position and a second locking position, wherein in the adjusting position, the cam is continuously adjustably positionable along and within the track with the sliding surfaces adjacent the runner and lips, and wherein in the locking position, the cam is positionable at any point along the track with the camming surfaces in engagement with the runner and lips and is frictionally secured therein by the first and second camming surfaces.

2. The sign mounting system in accordance with claim 1 wherein the lips are oriented inwardly of the track.

3. The sign mounting system in accordance with claim 1 wherein the lips each include a hook portion at an end thereof, the lips being in opposing relation to one another.

4. The sign mounting system in accordance with claim 1 wherein the mounting element is configured to mount the sign to an associated vertical structure.

5. The sign mounting system in accordance with claim 1 wherein the mounting element is configured to mount the sign to an associated horizontal structure.

6. The sign mounting system in accordance with claim 1 wherein the cam has an asymmetrical wedge shape formed by an intersection of the first camming surface and the second sliding surface at a front portion of the wedge.

7. The sign mounting system in accordance with claim 1 wherein the mounting element includes a base plate and an extension portion connecting the base plate and the cam.

8. A sign mounting system for adjustably mounting a sign such as a sheet or panel to an associated structure comprising:

an elongated frame portion mountable to the sign, the frame portion having a runner and side walls spaced from one another and extending generally transversely from the runner, the runner and side walls defining a track, each side wall terminating in a lip spaced from the runner a first predetermined distance, each lip including a hook portion at an end thereof, the lips being in opposing relation to one another; and a mounting element mountable to the associated structure and adjustably mountable to the frame portion, the mounting element having a cam having first and second sliding surfaces spaced from one another a distance substantially equal to the first predetermined distance, and first and second camming surfaces spaced from one another a distance greater than the first predetermined distance, the mounting element being pivotal between a first adjusting position and a second locking position, wherein in the adjusting position, the cam is adjustably positionable within the track with the sliding surfaces adjacent the runner and lips, and wherein in the locking position, the cam is positioned with the camming surfaces in engagement with the runner and lips, and wherein the mounting element includes a base plate and an extension portion connecting the cam and the base plate, and wherein the cam has grooves formed therein separated from one another by the extension portion, the grooves being further defined by cam outer walls.

9. The sign mounting system in accordance with claim 8 wherein the hook portions are configured to engage the grooves formed in the cam and the cam outer walls.

10. The sign mounting system in accordance with claim 1 wherein the cam includes an arcuate surface extending between the sliding surfaces.

11. The sign mounting system in accordance with claim 10 wherein the arcuate surface forms a portion of the second camming surface.

12. The sign mounting system in accordance with claim 1 wherein the sliding surfaces and camming surfaces are angularly disposed relative to one another by an angle $\alpha$.

13. A sign mounting system for adjustably mounting a sign such as a sheet or panel to an associated structure comprising:

an elongated frame portion mountable to the sign, the frame portion defining a longitudinal axis and further defining a track formed by longitudinally extending side walls, at least one of the side walls terminating in an inwardly oriented lip; and a mounting element fixedly mountable to the associated structure and adjustably mountable to the frame portion, the mounting element having a retaining portion insertable into the track and pivotal within the track in a plane generally parallel to the track axis between a first adjusting position and a second locking position, wherein the mounting element is continuously slidingly engageable with the frame portion by spaced parrallel first and second sliding surfaces when the retaining portion is in the first adjusting position, and wherein when the retaining portion at any point along the track is rotated into the second locking position the mounting element is frictionally, securedly engaged with the frame portion by first and second camming surfaces on the mounting element rotated into engagement with the frame portion.

14. The sign mounting system in accordance with claim 13 wherein each side wall includes an inwardly oriented lip and wherein the lips are oriented inwardly of the track in opposing relation to one another.

15. The sign mounting system in accordance with claim 14 wherein the lips each include a hook portion at an end thereof, the lips being in opposing relation to one another.

16. The sign mounting system in accordance with claim 13 wherein the retaining portion is a cam.

17. The sign mounting system in accordance with claim 16 wherein the cam has an asymmetrical wedge shape.

18. The sign mounting system in accordance with claim 13 wherein the retaining portion defines the sliding surfaces and the camming surfaces, the sliding surfaces engaging the track when the retaining portion is in the first adjusting position and the camming surfaces engaging the track when the retaining portion is in the second locking position.

* * * * *